US005692620A

United States Patent [19]

Christensen

[11] Patent Number: 5,692,620

[45] Date of Patent: Dec. 2, 1997

[54] FUNNEL APPARATUS FOR MINING GOLD

[76] Inventor: Rodney Carl Christensen, 19554 Ayers Ave., Escalon, Calif. 95320

[21] Appl. No.: 446,416

[22] Filed: May 22, 1995

[51] Int. Cl.[6] ..... B03B 11/00

[52] U.S. Cl. ..... 209/461; 209/494; 209/500

[58] Field of Search ..... 209/44, 255, 256, 209/257, 258, 458, 461, 488, 490, 494, 495, 489, 491, 496, 500

[56] References Cited

U.S. PATENT DOCUMENTS

| | | | |
|---|---|---|---|
| 640,117 | 12/1899 | Earle | 209/461 X |
| 674,169 | 5/1901 | Klein | 209/461 X |
| 1,146,682 | 7/1915 | Amis | 209/495 X |
| 4,033,863 | 7/1977 | Stone | 209/496 X |
| 4,126,542 | 11/1978 | Carlsmith | 209/258 |
| 4,264,439 | 4/1981 | Lefevre et al. | 209/496 X |
| 4,789,464 | 12/1988 | Kuryluk | 209/461 X |
| 4,913,807 | 4/1990 | Hendricks | 209/461 |
| 4,953,709 | 9/1990 | Kaufmann | 209/496 X |

*Primary Examiner*—Tuan Nguyen
*Attorney, Agent, or Firm*—Bernhard Kreten

[57] ABSTRACT

The apparatus includes a funnel, connected to a section of clear hose. The clear hose has installed in line, 3 valves, for regulating water flow to the funnel for the process of separating gold from gold bearing soil.

18 Claims, 1 Drawing Sheet

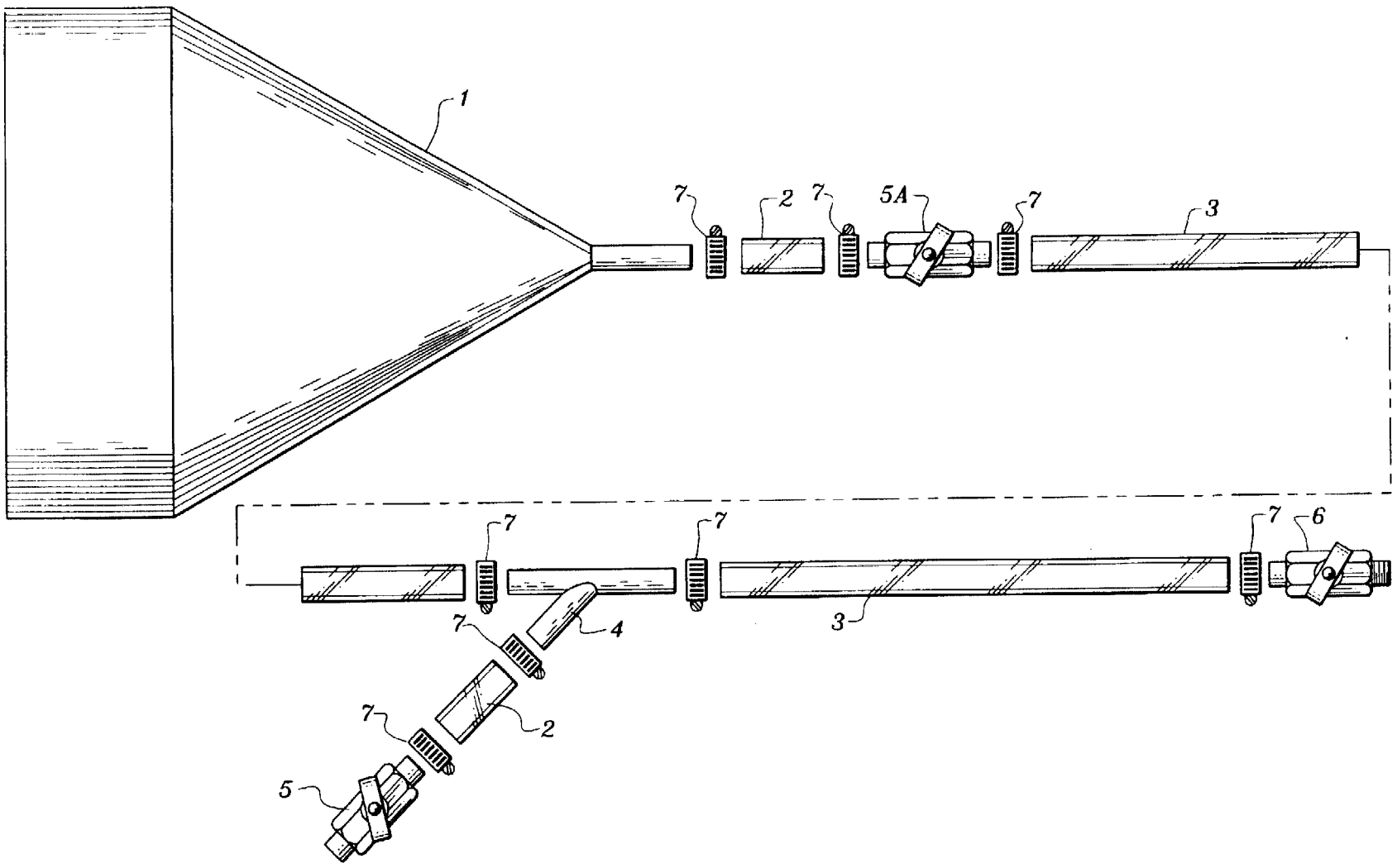
1
2
3
4
5
5A
6
7

FUNNEL APPARATUS FOR MINING GOLD

BACKGROUND OF THE INVENTION

This invention is used in the field of gold mining, where gold is separated from soil with the use of water and gravity.

DESCRIPTION OF THE PRIOR ART

Previous inventions pertaining to the separation of gold from soil required operator expertise to be at a high level of proficiency to preclude loosing large amounts of gold during the process of separating gold from gold bearing soil. Case in point is the gold pan. If the operator is not proficient, when washing overburden from the pan, gold can and usually does accompany washed soil off the edge of the pan.

In the case of a sluice box, if the water flow is too fast or too slow, or if the bed of the box is at the wrong angle, the operator could lose substantial amounts of gold ore off the end of the box. My Gold Funnel allows the operator to see any and all of the gold ore available and to separate it from the surrounding soil with no loss of ore.

SUMMARY OF THE INVENTION

It is the object of the invention to allow the operator to see the gold ore, if and when it is present, by percolating the gold bearing soil for a brief period and then controlling the water flow to allow just the gold ore to settle out of the gold bearing soil, be seen by the operator, and separated from the soil.

BRIEF DESCRIPTION OF THE DRAWINGS

The present invention will be more fully understood when the drawing of the Gold Funnel is viewed in conjunction with reading the detailed description. It is a front view, showing the five basic parts of the invention; funnel, hose, and three valves. Any other views of the invention would show the same five basic parts.

DETAILED DESCRIPTION OF THE INVENTION

The Gold Funnel is a device where the main body is a funnel 1 or can be constructed of suitable material (eg-metal-plastic-etc) so as to resemble a funnel, and the size of said funnel is based only on the requirements of the operator.

In the example to be reviewed in this presentation and the enclosed drawing, a one gallon capacity funnel with a ½" O.D. outlet will be used.

With the funnel held in the normal upright position, the ½" O.D. outlet shall be at the bottom.

A two foot section of clear plastic ½" I.D. hose 3 is attached to the funnel and secured with a ¼"×2½" hose clamp 7.

Two inches below the funnel outlet, the ½" I.D. hose 3 is separated and a ½" O.D. water valve 5A is installed in-line in the hose and secured with 2¼"×2½" hose clamps 7.

One foot below the valve 5A, the ½" I.D. hose 3 is again separated and a ½" O.D. plastic or metal 'Y' is installed. The main body of the 'Y' 4 is installed in-line in the hose and secured with 2¼"×2½" hose clamps 7. The branch of the 'Y' should be pointing up and away from the hose. Another water valve 5 is then attached to the branch, using a 2" piece of ½" I.D. clear plastic hose 2 and a ¼"×2½" hose clamp 7.

At the bottom end of the ½" I.D. clear plastic hose 3, a ¾" pipe×½" O.D. water valve 6 is attached, using a ¼"×2½" hose clamp 7.

The ¾" pipe end of valve 6 is for connecting the Gold Funnel to a fresh water supply.

For the size of gold funnel described here, the water supply should be 20 p.s.i. and 5 gallon per minute volume minimum. Larger funnels will require an equally larger volume of water.

With the Gold Funnel connected to a fresh water supply and valve 5A open, and valves 5 and 6 closed, fill funnel with gold bearing dirt. Slowly open valve 6 to let fresh water enter the funnel until the dirt in the funnel is percolating but not so much that the majority of the dirt and any gold ore is washed out of the funnel. Just light percolating and of short duration is usually all that is required to separate any gold ore from the surrounding dirt.

At the operator's discretion, valve 6 can then be slowly adjusted toward the closed position, restricting but not stopping the volume of water going through the Gold Funnel, in turn, allowing the heavier material (gold) to settle into the clear plastic hose below valve 5A and in view of the operator.

At that point the operator can isolate the ore in the hose by closing valve 5A. The gold ore then will settle to the bottom of the hose. Valve 5 can then be opened and any ore will be expelled from the hose, out valve 5 and into any suitable holding container.

To rewash the dirt to ensure all the gold has been claimed, close valve 5, open valve 5A and modulate valve 6 to the open position. Or, to start a new cycle with new dirt, close valve 6, dump the dirt and fill the funnel with new dirt.

The Gold Funnel can be held in the operation position by any number of ways, depending on the logistics of the operation. The only requirement is that the funnel be upright and the hose and valves be suspended below the funnel so as to take advantage of all available gravity.

I claim:

1. Apparatus for optimizing batch separation of gold ore from ore bearing soil, said apparatus comprising:

a source of gold ore bearing soil;

a funnel, said funnel having an inlet for holding an amount of gold ore bearing soil, and a funnel outlet;

an isolation means attach to said funnel outlet;

a transparent collecting pipe communicating with said isolation means, said transparent collecting pipe for collecting and holding gold ore separated from gold ore bearing soil;

a discharge means;

a Y fitting having two inlets and an outlet, one said inlet communicating with said transparent collecting pipe and said outlet communicating with said discharge means;

a water source;

a transparent source pipe for coupling said water source to another said inlet of said Y fitting; and a source means for isolating and modulating said water source.

2. Apparatus as claimed in claim 1, wherein said isolation means is a valve.

3. Apparatus as claimed in claim 2, wherein said valve is a ½" O.D. water valve.

4. Apparatus as claimed in claim 1, wherein said discharge means is a valve.

5. Apparatus as claimed in claim 4, wherein said valve is a ½" O.D. water valve.

6. Apparatus as claimed in claim 1, wherein said source means is a valve.

7. Apparatus as claimed in claim 6, wherein said valve is a ½" O.D. water valve.

8. Apparatus as claimed in claim 1, wherein said funnel has a one gallon capacity.

9. Apparatus as claimed in claim 8, wherein said funnel has ½" O.D. funnel outlet.

10. Apparatus as claimed in claim 1, wherein said transparent collecting pipe is a two foot section of hose having a ½" I.D.

11. Apparatus as claimed in claim 10, wherein said transparent collecting pipe is plastic.

12. Apparatus as claimed in claim 1, wherein said transparent source pipe is a two foot section of hose having a ½" I.D.

13. Apparatus as claimed in claim 12, wherein said transparent collecting pipe is plastic.

14. A device for separating more dense material which is mixed with less dense material comprising, in combination:

a tank having an interior for holding the material and including an outlet at a lowermost tank portion;

a conduit leading from said outlet having a first valve at an upper end of said conduit near said outlet and a second valve at a lower end of said conduit; and fluid connected to said conduit lower end and controlled by said second valve, and a branch passageway in fluid communication with said conduit between said first and second valves, said branch passageway having a third valve to open and close said branch passageway;

whereby with said first valve open, said third valve closed and by throttling said second valve, the more dense material sediments into said conduit and upon closing said first valve and opening said third valve, the more dense material is expressed through said branch passageway.

15. The device of claim 14 wherein said tank is shaped like a funnel with said outlet located at a narrowmost portion of said funnel.

16. The device of claim 15 wherein said conduit is transparent.

17. The device of claim 16 wherein the more dense material contains gold.

18. The device of claim 17 wherein the fluid is water.

* * * * *